US009591398B1

(12) United States Patent
Wang

(10) Patent No.: US 9,591,398 B1
(45) Date of Patent: Mar. 7, 2017

(54) HEADPHONE

(71) Applicant: Howard Wang, Hacienda Heights, CA (US)

(72) Inventor: Howard Wang, Hacienda Heights, CA (US)

( * ) Notice: Subject to any disclaimer, the term of this patent is extended or adjusted under 35 U.S.C. 154(b) by 0 days.

(21) Appl. No.: 15/058,813

(22) Filed: Mar. 2, 2016

(51) Int. Cl.

| | |
|---|---|
| ***H04R 25/00*** | (2006.01) |
| ***H04R 1/28*** | (2006.01) |
| ***H04R 1/10*** | (2006.01) |
| *H04R 5/033* | (2006.01) |

(52) U.S. Cl.
CPC ..... *H04R 1/2819* (2013.01); *H04R 1/1016* (2013.01); *H04R 1/1075* (2013.01); *H04R 1/1066* (2013.01); *H04R 1/2815* (2013.01); *H04R 5/033* (2013.01); *H04R 2420/07* (2013.01)

(58) Field of Classification Search
CPC ..... H04R 1/10; H04R 1/28; H04R 1/2815; H04R 1/1066; H04R 1/1075; H04R 1/1083; H04R 1/2807; H04R 1/2811; H04R 1/2819; H04R 1/2823; H04R 1/2826; H04R 1/2846; H04R 1/2849; H04R 1/2865; H04R 1/2869; H04R 1/2873; H04R 5/033; H04R 5/0335
USPC ..... 381/370, 371, 372, 373, 382, 384, 74, 381/349, 351, 353, 354, 26; 181/156, 181/199, 182, 129, 137; 455/575.2
See application file for complete search history.

(56) References Cited

U.S. PATENT DOCUMENTS

| | | | | | |
|---|---|---|---|---|---|
| 3,751,608 | A * | 8/1973 | Weingartner | H04R 1/1075 | 381/372 |
| 4,239,945 | A * | 12/1980 | Atoji | H04R 1/2819 | 381/349 |
| 4,742,887 | A * | 5/1988 | Yamagishi | H04R 1/2857 | 181/129 |
| 5,208,868 | A * | 5/1993 | Sapiejewski | H04R 1/1083 | 381/338 |
| 5,327,507 | A * | 7/1994 | Suzuki | H04R 1/1016 | 381/345 |
| 7,614,479 | B2 * | 11/2009 | Plummer | H04R 1/2857 | 181/148 |
| 8,538,059 | B2 * | 9/2013 | Yamagishi | H04R 1/2819 | 181/128 |
| 8,731,223 | B2 * | 5/2014 | Seo | H04R 1/2811 | 381/338 |
| 8,897,478 | B2 * | 11/2014 | Yang | H04R 1/1041 | 381/370 |
| 2004/0264727 | A1 * | 12/2004 | Kim | H04R 1/2819 | 381/370 |

* cited by examiner

*Primary Examiner* — Xu Mei
(74) *Attorney, Agent, or Firm* — Clement Cheng

(57) ABSTRACT

A headphone has a main bass reflex chamber formed inside a housing sidewall. A transducer is mounted in the main bass reflex chamber at a transducer enclosure portion of the main bass reflex chamber. An earbud insert is mounted to the main bass reflex chamber and receives sound from the transducer. The earbud insert has an earbud opening formed at an earbud tip of the earbud insert. The earbud opening connects to an earbud channel. A stem extends from the main bass reflex chamber. The stem has a reflex connector channel. A reflex module is attached to the stem selected from either: a first reflex module removably secured to the stem of the main bass reflex chamber; or a second reflex module removably secured to the stem of the main bass reflex chamber when the first reflex module is removed from the stem of the main bass reflex member.

18 Claims, 2 Drawing Sheets

HEADPHONE

FIELD OF THE INVENTION

The present invention is in the field of headphones, more specifically earphones.

DISCUSSION OF RELATED ART

Bass reflex ports allow speakers to provide a supplemental output for low-frequency sound vibrations.

SUMMARY OF THE INVENTION

A headphone has a main bass reflex chamber formed inside a housing sidewall. A transducer is mounted in the main bass reflex chamber at a transducer enclosure portion of the main bass reflex chamber. An earbud insert is mounted to the main bass reflex chamber and receives sound from the transducer. The earbud insert has an earbud opening formed at an earbud tip of the earbud insert. The earbud opening connects to an earbud channel. A stem extends from the main bass reflex chamber. The stem has a reflex connector channel. A reflex module is attached to the stem selected from either: a first reflex module removably secured to the stem of the main bass reflex chamber; or a second reflex module removably secured to the stem of the main bass reflex chamber when the first reflex module is removed from the stem of the main bass reflex member.

The second reflex module has a different acoustical quality than the first reflex module. The first reflex module is formed with a reflex opening. The reflex opening has a reflex opening damper pad mounted to the reflex opening. The first reflex module has a reflex opening seal mounted over the reflex opening. The damper pad is mounted to the reflex opening seal. The second reflex module is formed with a closed wall, and the second reflex module optionally does not have a reflex opening. The printed circuit board is formed in the main bass reflex chamber. The transducer is mounted on the printed circuit board. The printed circuit board may have an antenna for receiving wireless signals.

The first reflex module and the second reflex module selectively provide different Helmholtz frequencies to the main bass reflex chamber. The reflex module receives sound vibration ported through a reflex opening of the reflex module. Sound vibration travels through the reflex module along a reflex module barrel then to the stem, then to the bass reflex chamber, then to the earbud shoulder, and then to the earbud insert. The reflex module receives sound vibration ported through a reflex opening of the reflex module. The stem is preferably cylindrical and externally threaded with external threads on an external sidewall of the stem. The reflex module is internally threaded to receive the external threads of the stem. The reflex module includes a reflex hollow that is adjustable in size by rotating the reflex module relative to the stem on a threaded connection.

BRIEF DISCUSSION OF THE DRAWINGS

Figure 1:
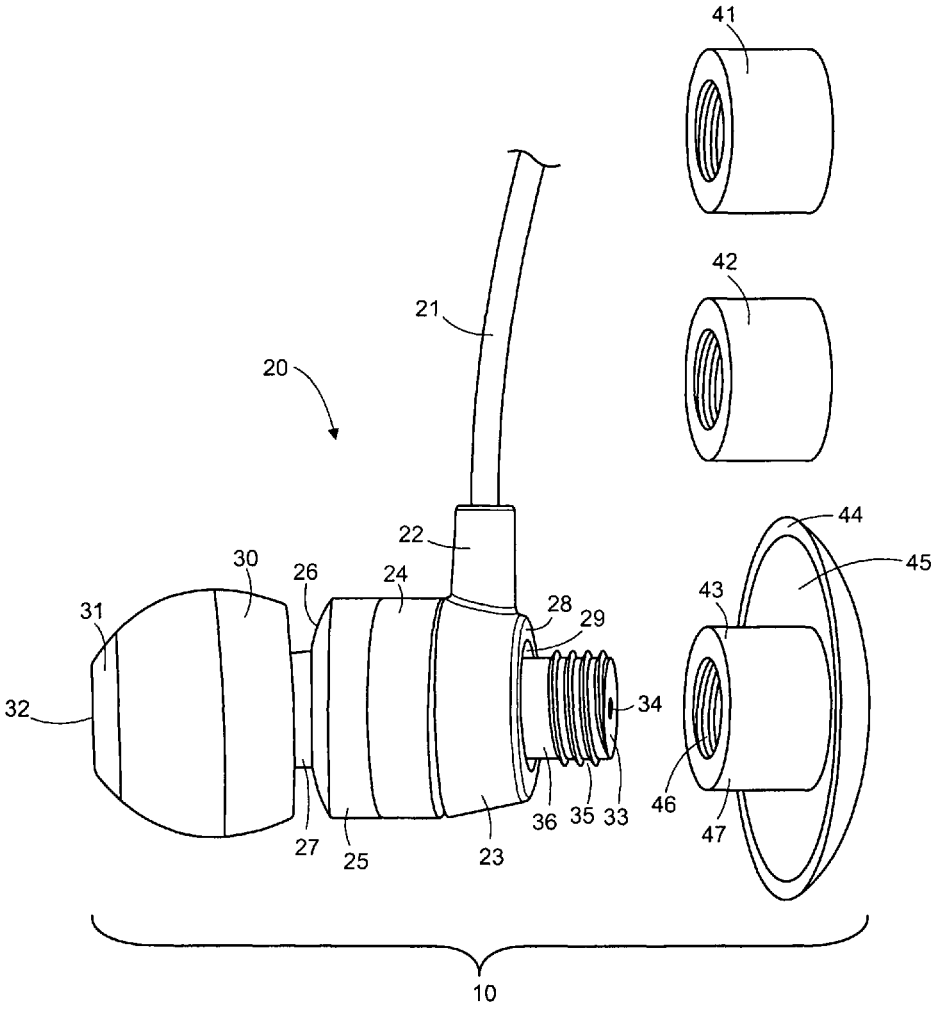
FIG. 1 is a side view diagram of a headset with multiple interchangeable bass modules.
Figure 2:
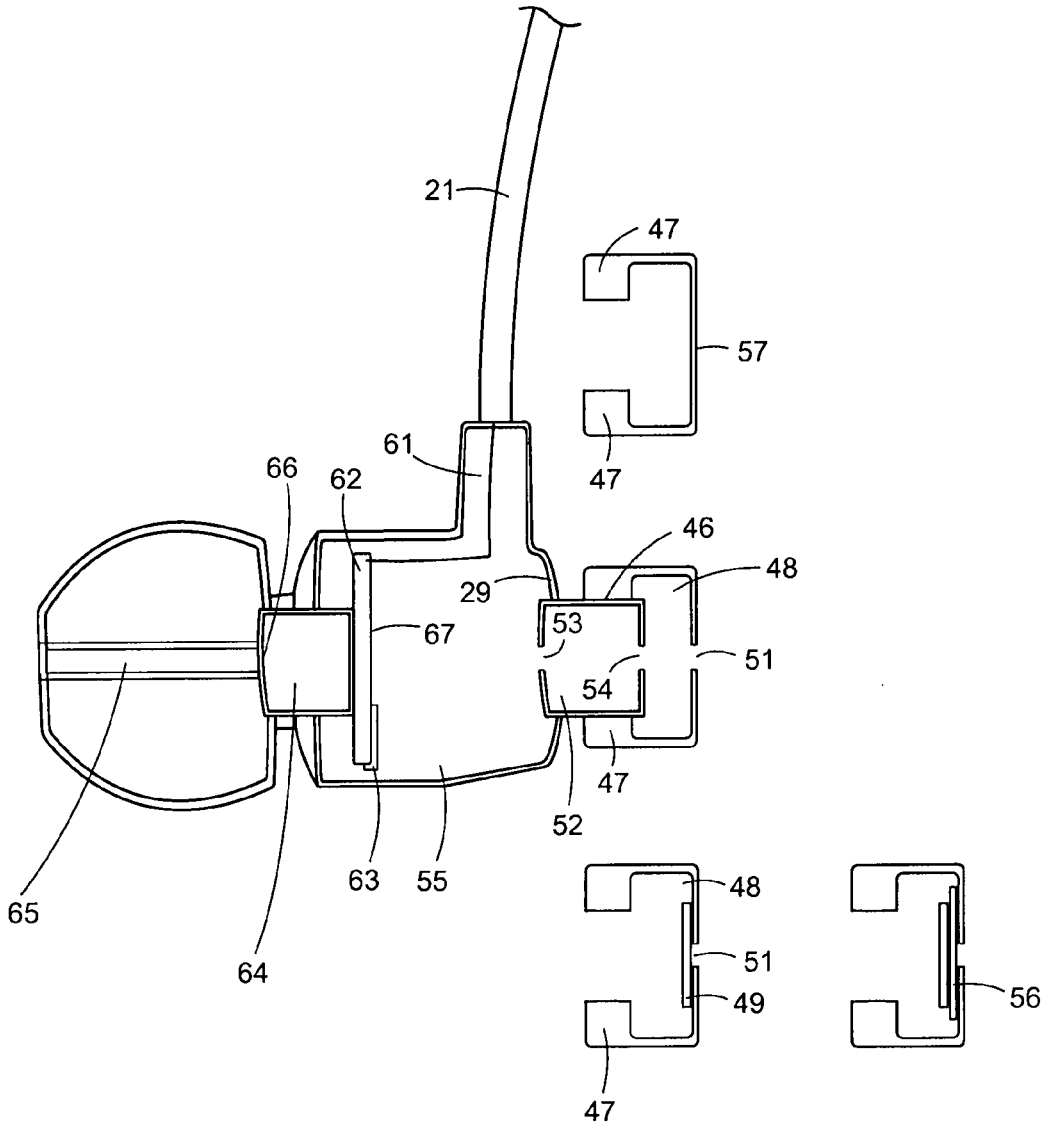
FIG. 2 is a cross-section diagram of the present invention also showing the bass modules.

The following call out list of elements can be a useful garden referencing the elements of the drawings.

10 Headset
20 Transducer Housing

21 Wire Harness
22 Flexible Shroud
23 Harness Retainer
24 Housing Sidewall
25 Transducer Enclosure
26 Earbud Shoulder
27 Earbud Neck
28 Housing External Face
29 Housing External End
30 Earbud Insert
31 Earbud Tip
32 Earbud Opening
33 Stem Face
34 Stem Opening
35 Stem Threaded Connection
36 Stem Sidewall
41 First Bass Reflex Module
42 Second Bass Reflex Module
43 Third Bass Reflex Module
44 Reflex Module Rim
45 Reflex Module Hood
46 Bass Reflex Thread
47 Reflex Module Barrel Having Internally Threaded Reflex Collar
48 Reflex Hollow
49 Reflex Opening Damper Pad
51 Reflex Opening
52 Reflex Connector Channel
53 Inside Connector Channel Opening
54 Outside Connector Channel Opening
55 Main Bass Reflex Chamber
56 Reflex Opening Seal
57 Closed Wall
61 Connection Wire
62 Printed Circuit Board
63 Antenna
64 Transducer
65 Earbud Channel
66 Earbud Transducer Connection

DETAILED DESCRIPTION OF THE PREFERRED EMBODIMENT

The present invention is a headset 10 that has an earbud mounted on an earphone with modular bass reflex units that are interchangeable and each having their own sound properties for controlling a Helmholtz frequency. Thus, the modular bass reflex units together comprise a single Helmholtz selection means. The modular bass reflex ports come in pairs for a pair of earphones commonly controlled by an electronic device through an audio jack connection. For purposes of illustration, only the earphone portion of the entire headset is shown.

A transducer housing 20 receives a wire harness 21 at a flexible shroud 22 formed on the transducer housing 20. The wire harness 21 can have one or more insulated wires braided around a steel cable and encapsulated within an insulated shroud. The steel cable within the wire harness 21 can provide a resistance to pulling. The flexible shroud 22 can be formed of an elastomeric material that is formed along with the harness retainer 23. The elastomeric material of the flexible shroud 22 and the harness retainer 23 can be a rubbery flexible material that is molded onto the housing sidewall 24 to cover a portion of the housing sidewall 24. The housing sidewall 24 can be an anodized aluminum member that has an exposed surface next to the harness retainer 23. The harness retainer 23 and the flexible shroud 22 can be integrally formed in a single step to be molded around the anodized aluminum member of the housing sidewall 24 after the housing sidewall 24 is formed.

The housing sidewall 24 includes a transducer enclosure 25 that retains a transducer. The transducer enclosure has an earbud shoulder 26 which rises to an earbud neck 27. The sound vibrations from the transducer travel through the earbud neck 27 into an earbud insert 30. The earbud insert 30 is a flexible elastomeric earpiece that is configured to fit into an ear canal. The earbud insert 30 terminates at an earbud tip 31. An earbud opening 32 is formed on the earbud tip 31. The transducer enclosure 25 forms a sound concentrating chamber to direct sound to a listener.

The outside side of the earphone includes a housing external face 28 formed at a housing external end 29. The earbud insert 30 is opposite the housing external end 29. A stem having a stem sidewall 36 extends from the housing external end 29. The stem sidewall 36 is cylindrical and formed with a stem opening 34, which can be formed as a bore. The stem sidewall 36 receives a stem threaded connection 35 that terminates at a stem face 33. The stem face 33 has a stem opening 34 formed on it. The threaded connection is an external thread formed on an external surface of the stem sidewall. The externally threaded stem sidewall connects with an internally threaded base reflex module to allow selective release and attachment of different base reflex modules.

The bass reflex module has a bass reflex thread 46 internally threaded to attach to the externally threaded stem sidewall. The bass reflex module system includes multiple bass reflex modules such as a first bass reflex model 41, a second bass reflex module 42 and a third bass reflex model 43. The bass reflex module can have a reflex module hood 45 having a reflex module rim 44. The reflex module hood 45 can be attached to the closed wall 57. The bass reflex thread 46 is formed on a bore formed on the reflex module barrel that preferably has an internally threaded reflex collar. The bass reflex port is formed at the stem opening 32 and then made interchangeably modifiable by selecting among a group of modules having different bass reflex port qualities.

As seen in the second figure, the connection wire 61 comes from the wire harness 21 and extends through the main bass reflex chamber 55. The connection wire 61 connects to a printed circuit board 62. The printed circuit board 62 has an optional antenna 63 for receiving signals such as a Bluetooth signal. The printed circuit board can be powered by a battery, or by 5 V voltage received from the wire harness 21. The transducer 64 is preferably mounted to, or mounted adjacent to the printed circuit board 52. The transducer 64 has an earbud transducer connection 66 that outputs sound from the transducer 64 into the earbud channel 65. The earbud channel 65 terminates at the earbud opening 32 to deliver sound to the ear canal of a user. The earbud channel 55 is preferably sized according to a human ear canal. The earbud channel 55 is preferably made of flexible elastomeric material and integrally formed with the earbud insert 33, which has a flexible shroud mushroom shape to connect as a plug to a human ear of a user. The earbud channel 55 can fit over a nipple of the earbud transducer connection 66 to provide a snug fit. The transducer 64 is preferably mounted in the bass reflex chamber 55.

When the transducer 64 activates, the bass reflex chamber 55 also receives sound that passes from the transducer 64. The sound that enters the bass reflex chamber can have a Helmholtz frequency or a natural frequency of the vibrations. The Helmholtz frequency can be modified selectively using the selective modules that are selectively attachable. One drawback of the present invention is that unused bass reflex modules are small and might be easily misplaced. The sound that enters the bass reflex chamber 55 passes through an inside connector channel opening 53 and then passes through a reflex connector channel 52 until it reaches an outside connector channel opening 54. The inside connector channel opening 53 is preferably larger than the outside connector channel opening 54. The outside channel connector opening 54 exits at the stem opening 34. The reflex connector channel 52 funnels low-frequency sound waves from the bass reflex chamber 55 to the stem opening 34. The stem opening 34 can be closed by implementing a closed wall 57 formed over the reflex module barrel 47 so that the sound is reflected from a hard surface of the closed wall 57. The closed wall 57 can abut to the stem opening 34 at the outside connector channel opening 54, or can be offset a distance away from the stem opening 34 at the outside connector channel opening 54.

The reflex connector channel 52 can be elongated or short. The reflex connector channel 52 is optional. Similarly, the reflex hollow 48 is also optional. The dimensions of the reflex hollow 48 can be adjusted according to user preference. A user can turn the reflex module so that the reflex opening 51 is further away from the outside connector channel opening 54, or closer to the outside connector channel opening 54. The reflex hollow 48 can be completely closed off such as if the outside connector channel opening 54 were screwed against the reflex opening 51.

Different reflex modules can have different bass port frequency outputs. The bass sound and frequency output can be modified. Reflection of vibrations against the housing external end 29 can make their way around the printed circuit board 62, along the housing of the main bass reflex chamber 55, then down the earbud shoulder 26 until they reach the earbud neck 27 where the earbud insert 30 is attached to the earbud neck 27 at the earbud transducer connection 66 so that sound vibrations can end up in the earbud channel 65 which receives vibration from the earbud transducer connection 66. Thus, the base port frequency output can be modified in a variety of different ways. For example, a reflex opening 51 can have a reflex hollow 48 that has a reflex opening damper pad 49 covering the reflex opening 51. The reflex opening damper pad 49 could be made of a soft material such as a fabric. For a different low frequency profile, the damper pad 49 can be mounted on a reflex opening seal 56 formed as a thin plastic membrane. The reflex opening seal 56 seals across the reflex opening 51 and can be made of a plastic sheet that is thermally laminated or adhered to the inside surface of the reflex hollow 48 so that a relatively airtight or air impermeable membrane is formed. The reflex opening seal 56 can be a sympathetic membrane that operates to receive frequency from the main bass reflex chamber 55 and then transmitting it back along the housing such as the main bass reflex chamber 55. The reflex opening seal 56 could be glued to the reflex opening damper pad 49 for a variety of different frequency responses. Also, the reflex opening 51 can be completely unimpeded by a reflex opening seal 56 or a reflex opening damper pad 49.

In actual use, a user can install the first reflex module such as the closed end reflex module and try listening to a few songs. The user could then try the other reflex modules and see which one they prefer. Since each of the bass reflex modules would have a slightly different sound, users can adjust the modules based upon preference. Listening to different music may prompt the user to change modules to optimize listening pleasure. For allowing a user to have better grip, a grip surface can be rolled or formed on the outside surface of the reflex module barrel 47.

The invention claimed is:

1. A headphone comprising:

a main bass reflex chamber formed inside a housing sidewall;

a transducer mounted in the main bass reflex chamber at a transducer enclosure portion of the main bass reflex chamber;

an earbud insert mounted to the main bass reflex chamber, wherein the earbud insert receives sound from the transducer, wherein the earbud insert has an earbud opening formed at an earbud tip of the earbud insert, wherein the earbud opening is connects to an earbud channel;

a stem extending from the main bass reflex chamber, wherein the stem has a reflex connector channel;

a reflex module attached to the stem selected from either: a first reflex module removably secured to the stem of the main bass reflex chamber; or a second reflex module removably secured to the stem of the main bass reflex chamber when the first reflex module is removed from the stem of the main bass reflex member, wherein the second reflex module has a different acoustical quality than the first reflex module.

2. The headphone of claim 1, wherein the first reflex module is formed with a reflex opening, wherein the reflex opening has a reflex opening damper pad mounted to the reflex opening.

3. The headphone of claim 2, wherein the first reflex module has a reflex opening seal mounted over the reflex opening, wherein the damper pad is mounted to the reflex opening seal.

4. The headphone of claim 1, wherein the second reflex module is formed with a closed wall, wherein the second reflex module does not have a reflex opening.

5. The headphone of claim 1, further including a printed circuit board formed in the main bass reflex chamber, wherein the transducer is mounted on the printed circuit board.

6. The headphone of claim 5, wherein the printed circuit board further includes an antenna for receiving wireless signals.

7. The headphone of claim 1, wherein the first reflex module and the second reflex module selectively provide different Helmholtz frequencies to the main bass reflex chamber.

8. The headphone of claim 1, wherein the reflex module receives sound vibration ported through a reflex opening of the reflex module, wherein sound vibration travels through the reflex module along a reflex module barrel then to the stem, then to the bass reflex chamber, then to the earbud shoulder, then to the earbud insert.

9. The headphone of claim 1, wherein the reflex module receives sound vibration and transfers to the earbud insert.

10. The headphone of claim 1, wherein the stem is cylindrical and externally threaded with external threads on an external sidewall of the stem, wherein the reflex module is internally threaded to receive the external threads of the stem.

11. The headphone of claim 10, wherein the first reflex module is formed with a reflex opening, wherein the reflex opening has a reflex opening damper pad mounted to the reflex opening.

12. The headphone of claim 11, wherein the first reflex module has a reflex opening seal mounted over the reflex opening, wherein the damper pad is mounted to the reflex opening seal.

13. The headphone of claim 10, wherein the second reflex module is formed with a closed wall, wherein the second reflex module does not have a reflex opening.

14. The headphone of claim 10, further including a printed circuit board formed in the main bass reflex chamber, wherein the transducer is mounted on the printed circuit board.

15. The headphone of claim 14, wherein the printed circuit board further includes an antenna for receiving wireless signals.

16. The headphone of claim 10, wherein the first reflex module and the second reflex module selectively provide different Helmholtz frequencies to the main bass reflex chamber.

17. The headphone of claim 10, wherein the reflex module receives sound vibration ported through a reflex opening of the reflex module, wherein sound vibration travels through the reflex module along a reflex module barrel then to the stem, then to the bass reflex chamber, then to the earbud shoulder, and then to the earbud insert.

18. The headphone of claim 10, wherein the reflex module further includes a reflex hollow that is adjustable in size by rotating the reflex module relative to the stem on a threaded connection.

* * * * *